United States Patent [19]

Spamer

[11] Patent Number: 4,960,210

[45] Date of Patent: Oct. 2, 1990

[54] GRAVITY FEED GONDOLA BASE

[75] Inventor: William S. Spamer, Roswell, Ga.

[73] Assignee: The Mead Corporation, Dayton, Ohio

[21] Appl. No.: 373,384

[22] Filed: Jun. 29, 1989

[51] Int. Cl.[5] ..... A47F 7/00

[52] U.S. Cl. ..... 211/59.2; 211/183; 211/187

[58] Field of Search ..... 211/59.2, 193, 187, 211/135, 190, 182, 183; 108/108, 111; 248/247

*Primary Examiner*—David M. Purol
*Assistant Examiner*—Sarah A. Lechok
*Attorney, Agent, or Firm*—Rodgers & Rodgers

[57] ABSTRACT

A gravity feed gondola base is arranged for placement with a pair of horizontal parallel gondola support beams connected respectively to a pair of vertical gondola posts and includes an inner and an outer shoe box enveloping each of the support beams, an inwardly projecting support tab struck from each of the inner shoe boxes, a rear cross beam secured at its ends to the support tabs, an inwardly projecting support strip secured to each of the shoe boxes at a level below the support tabs, front and intermediate cross beams supported at their ends respectively on the support strip, low friction chutes mounted on the cross beams for slidably supporting articles displayed thereon and an article arresting device mounted on the front cross support.

10 Claims, 2 Drawing Sheets

GRAVITY FEED GONDOLA BASE

TECHNICAL FIELD

This invention relates generally to display devices of the gravity feed type which are used in conjunction with article display gondolas commonly used in supermarkets for displaying items such as soft drinks and the like.

BACKGROUND ART

U.S. Pat. No. 4,454,948 issued June 19, 1984 and owned by the assignee of this invention discloses a gravity feed display unit which preferably is constructed primarily of foam material. Experience has shown that foam material is not entirely satisfactory because the foam material is subject to attack by adverse environmental conditions.

U.S. Pat. No. 4,314,648 issued Feb. 9, 1982 and owned by the assignee of this invention discloses a gravity feed device in which the base element is tilted backwardly. Backward tilting of the base element together with downward tilting of the shelves tends to limit the usability of the space below the lowermost shelf. The base itself also utilizes space which limits the number and size of articles which can be displayed.

SUMMARY OF THE INVENTION

According to this invention in one form, a display gondola is modified by removing the gondola base and kick plate and the gravity feed base formed according to this invention is substituted thus utilizing the dead space under the base shelf and the space which in some displays is not used efficiently because articles remote from the front of the base are virtually inaccessible to customers. The invention provides total conversion of a gondola to gravity feed when applied to gravity shelving.

A gravity feed gondola base is arranged for placement with a pair of horizontal parallel gondola support beams connected respectively to a pair of vertical gondola posts. The base comprises an inner and an outer shoe box arranged to envelope each of said support beams, an inwardly projecting support tab struck from each of said inner shoe boxes, a rear cross beam secured at its ends respectively to said support tabs, an inwardly projecting support strip formed integrally with the lower edge of each of said inner shoe boxes, a front cross beam secured at its ends respectively on said support strips, an intermediate cross beam secured at its ends respectively to said support strips, low friction means mounted on said rear cross beam, said front cross beam and said intermediate cross beam for slidably supporting articles displayed thereon and article arresting means mounted on said front cross support.

BEST MODE OF CARRYING OUT THE INVENTION

Figure 1:
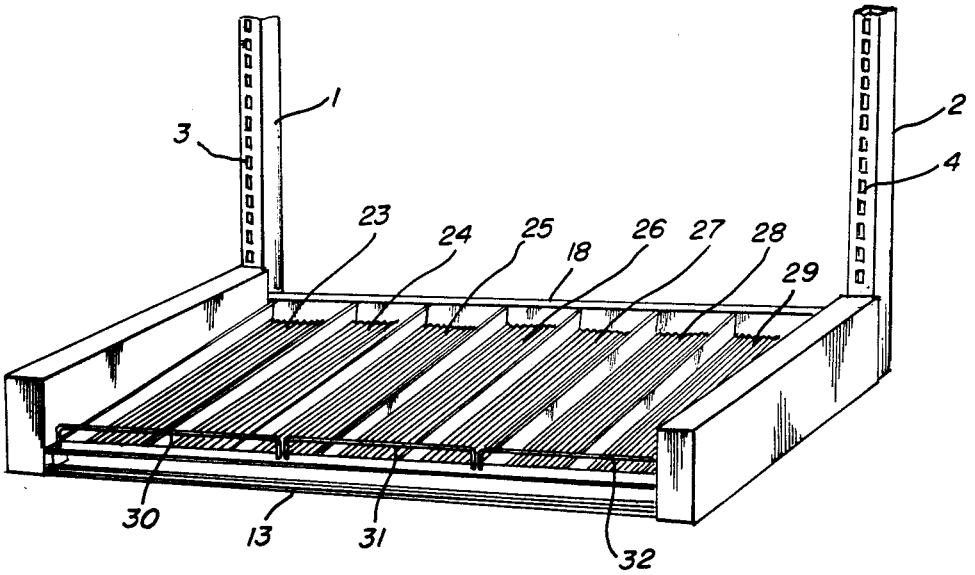
FIG. 1 is a perspective view of a gravity feed gondola base formed according to this invention.
Figure 2:
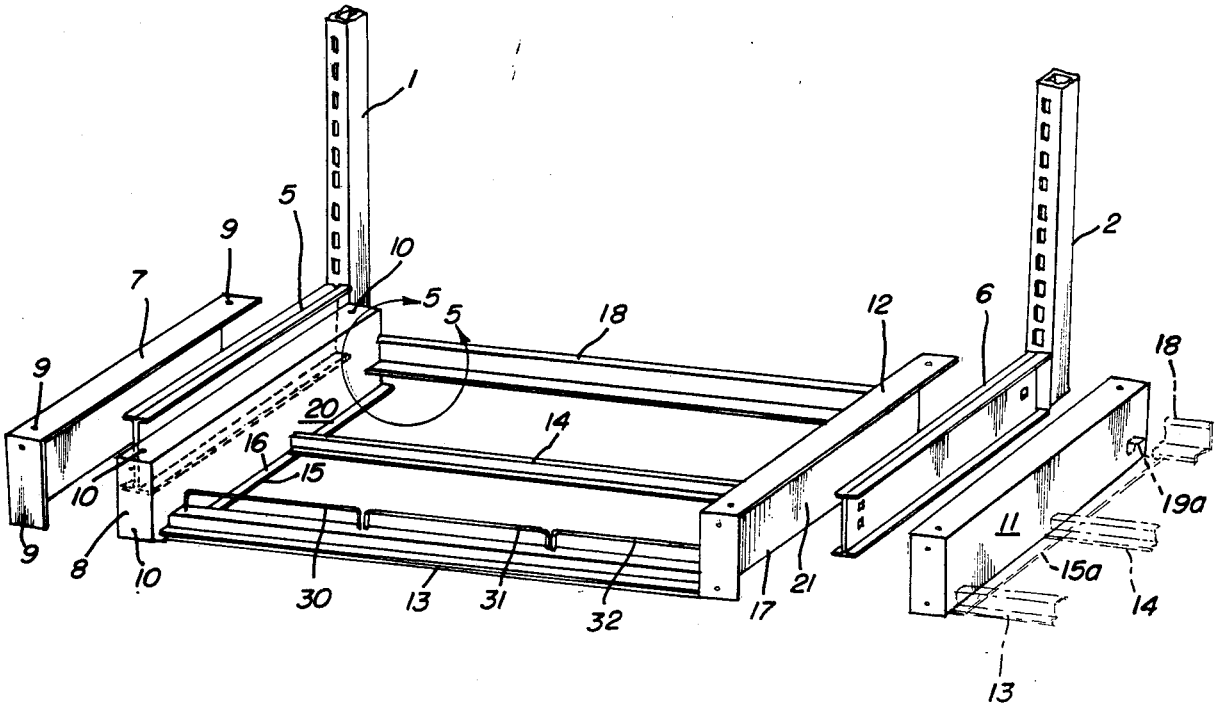
FIG. 2 a view similar to FIG. 1 but with the low friction gravity feed chutes removed and with some parts exploded.
Figure 3:
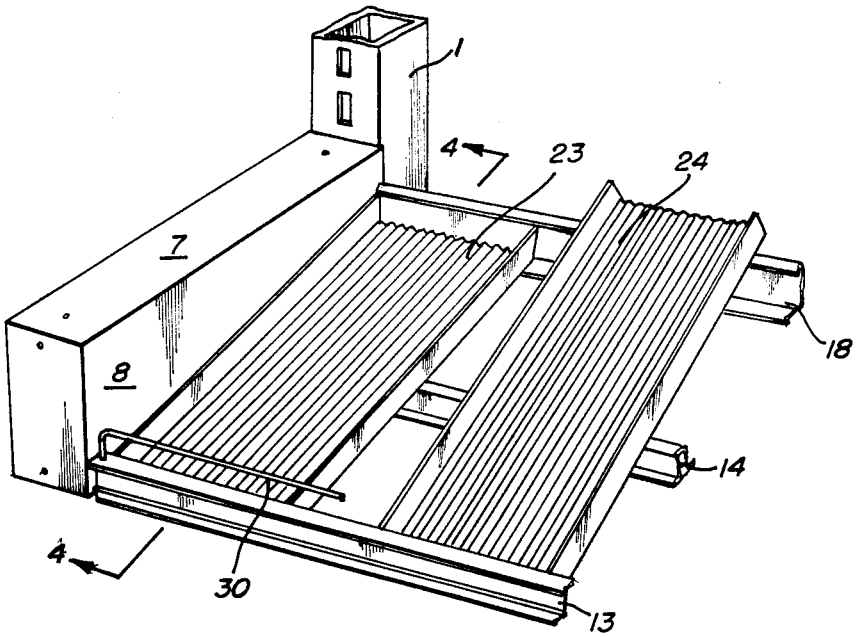
FIG. 3 is an enlarged perspective view similar to an end portion of FIG. 1 and which shows one low friction chute in place and a second low friction chute in the process of being installed.
Figure 4:
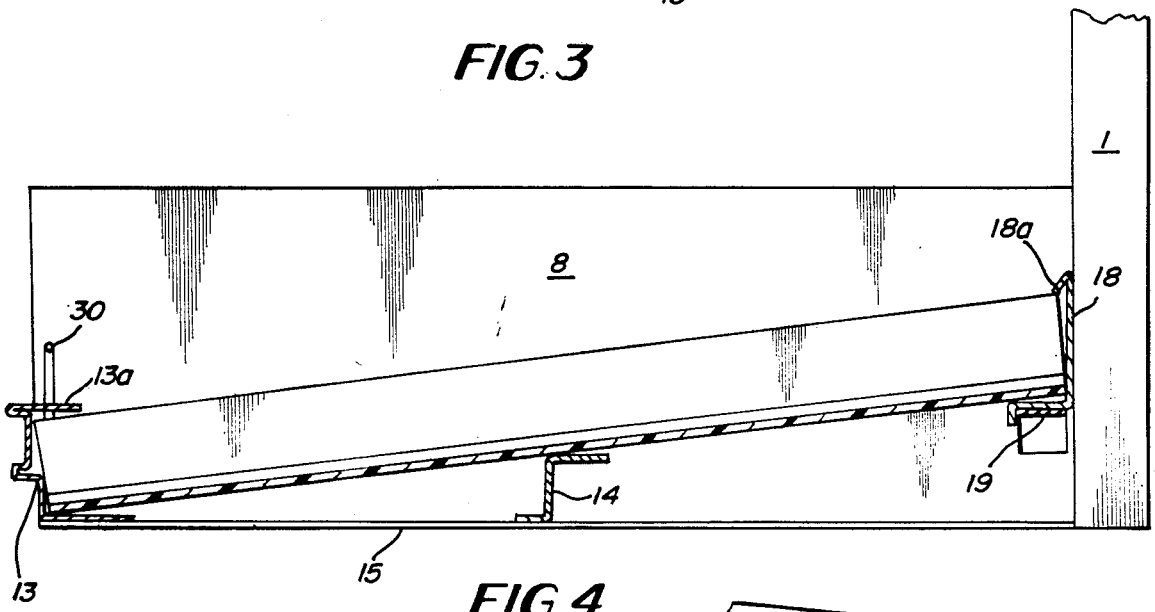
FIG. 4 is a cross sectional view taken along the line designated 4—4 in FIG. 3.

With reference primarily to FIGS. 1 and 2, a pair of vertically disposed gondola posts are designated by the numerals 1 and 2. Posts 1 and 2 include vertically arranged apertures 3 and 4 for receiving in known manner hook shaped elements secured to the ends of I-beam structures 5 and 6. Elements 1-6 constitute standard components of point of purchase gondolas. Outer shoe box 7 is complementary to inner shoe box 8. When assembled outer shoe box 7 and inner shoe box 8 envelope the I-beam 5 and are secured together by fastening means such as screws inserted into apertures 9 in outer shoe box 8 and corresponding apertures 10 formed in inner shoe box 8. In like fashion, outer shoe box 11 and inner shoe box 12 envelope the I-beam 6 and the structure appears as shown in FIG. 1.

Figure 5:
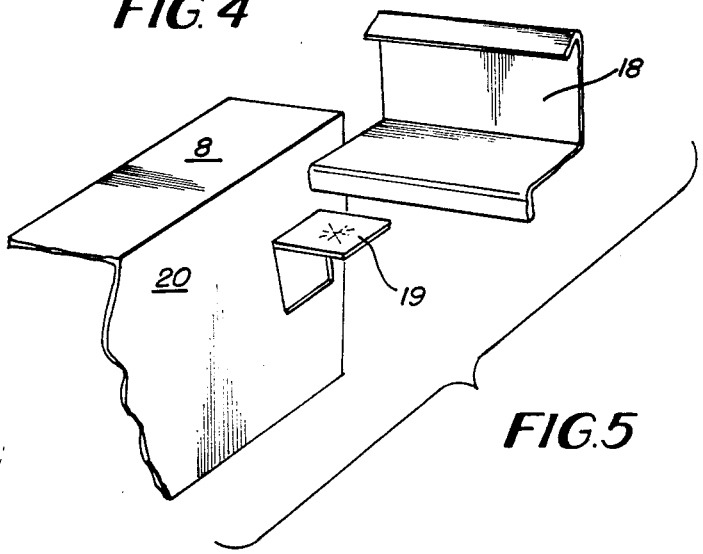
FIG. 5 is an enlarged exploded view of the structure enveloped by the circular line 5—5 in FIG. 2.

For supporting front cross beam 13 and intermediate cross beam 14, a strip 15 is integrally formed with the lower edge 16 of inner shoe box 8. The left hand ends of front cross beam 13 and of intermediate cross beam 14 are welded or otherwise secured to the inwardly projecting supporting strip 15. A similar strip to supporting strip 15 is integrally formed with the bottom edge 17 of inner shoe box 12 but is not observable in the drawing. Of course the right hand ends of front cross beam 13 and of intermediate cross beam 14 are welded or otherwise secured atop the inwardly projecting support strip secured to the bottom edge 17 of inner shoe box 12. Rear cross beam 18 is welded atop the support tab 19 which is struck from the inner wall 20 of inner shoe box 8 as is best shown in FIG. 5. Of course a similar tab is struck from the vertical wall 21 of inner shoe box 12 but is not observable in the drawings.

Low friction means is supported by the front cross beam 13, the intermediate cross beam 14 and the rear cross beam 18. The low friction means as shown in FIG. 1 for example includes a plurality of low friction chutes 23–29 as shown in FIG. 1.

The back portion of the chutes 23–29 is disposed below the projection **18*a* of the cross beam 18. This projection restrains the chutes against upward movement. Similarly the front cross beam 13 includes a projection 13*a* which overlies the front portion of the chutes 23–29** and thus restrains these elements from inadvertent dislodgement from their service positions.

For the purpose of arresting downward movement of articles which are fed forwardly on the chutes 23–29, arresting elements 30, 31 and 32 are secured to front cross beam 13 in known manner as best shown in FIGS. 1 and 2.

Cooperation with an adjacent gondola is contemplated by the provision of a support tab **19*a* and a support strip 15*a* applied to an outer shoe box such as 11 to support cross bars 13, 14 and 18 as indicated in FIG. 2. Of course similar structure could be applied to shoe box 7 in case another gondola is disposed to the left of the gondola base shown in FIGS. 1 and 2**.

For purposes of durability and reliability all of the parts comprising this invention are formed of metal preferably of steel except the plastic chutes designated 23–29. These plastic chutes may be formed according to U.S. Pat. No. 4,565,725 issued Jan. 21, 1986 and owned by the assignee of this invention.

According to this invention, a gravity feed gondola base is provided which is mechanically strong and durable and which is attractive in appearance and blends well with other gondola components and with other display devices.

I claim:

1. A gravity feed gondola base arranged for placement with a pair of horizontal parallel gondola support beams connected respectively to a pair of vertical gondola posts, said base comprising an inner and an outer shoe box enveloping each of said support beams, an inwardly projecting support tab struck from each of said inner shoe boxes, a rear cross beam secured at its ends respectively to said support tabs, an inwardly projecting support strip secured to each of said inner shoe boxes at a level below said support tabs, a front cross beam secured at its ends respectively to said support strips, low friction means mounted on said rear cross beam and said front cross beam for slidably supporting articles displayed thereon, and article arresting means mounted on said front cross support.

2. A gravity feed gondola base according to claim 1 wherein an intermediate cross beam is secured at its ends respectively on said support strips and arranged below and in engagement with said low friction means.

3. A gravity feed gondola base according to claim 1 wherein said low friction means comprises a plurality of chutes disposed in side by side downwardly inclined attitude.

4. A gravity feed gondola base according to claim 1 wherein said outer shoe box and said inner shoe box are secured together in complementary relation about each of said support beams.

5. A gravity feed gondola base according to claim 1 wherein said rear cross beam includes a projection which overlies and restrains said low friction means against upward movement out of engagement with said rear cross beam.

6. A gravity feed gondola base according to claim 1 wherein said front cross beam includes a projection which overlies and restrains said low friction means against upward movement out of engagement with said front cross beam.

7. A gravity feed gondola base according to claim 1 wherein said inwardly projecting support strips are disposed on the floor underlying and supporting the gondola.

8. A gravity feed gondola base according to claim 1 wherein said inwardly projecting support strips are integrally formed with the bottom edge of said inner shoe boxes.

9. A gravity feed gondola base according to claim 1 wherein at least one of said outer shoe boxes includes a support strip and a support tab for cooperating with front, rear and intermediate cross beams of an adjacent gondola.

10. A gravity feed gondola base according to claim 2 wherein said inner and said outer shoe boxes, said rear, front and intermediate cross beams, and said article arresting means are formed of metal and said low friction means is formed of low friction plastic material.

* * * * *